US008439121B2

(12) United States Patent
Nikiforuk et al.

(10) Patent No.: US 8,439,121 B2
(45) Date of Patent: May 14, 2013

(54) HYDRAULIC INTERLOCK SYSTEM BETWEEN CASING GRIPPER AND SPIDER

(75) Inventors: Kevin J. Nikiforuk, Cypress, TX (US); Dave C. Andrews, Bryan, TX (US)

(73) Assignee: Tesco Corporation, Houston, TX (US)

( * ) Notice: Subject to any disclaimer, the term of this patent is extended or adjusted under 35 U.S.C. 154(b) by 400 days.

(21) Appl. No.: 12/764,219

(22) Filed: Apr. 21, 2010

(65) Prior Publication Data

US 2011/0114308 A1 May 19, 2011

Related U.S. Application Data

(60) Provisional application No. 61/261,570, filed on Nov. 16, 2009.

(51) Int. Cl.
*E21B 19/16* (2006.01)
*E21B 19/22* (2006.01)

(52) U.S. Cl.
USPC ..... 166/380; 166/77.51; 166/77.53

(58) Field of Classification Search ..... 166/250.1, 166/77.1, 77.51, 77.53, 85.1, 377, 378, 380
See application file for complete search history.

(56) References Cited

U.S. PATENT DOCUMENTS 3,999,610 A * 12/1976 Sage et al. ..... 166/383
4,085,796 A * 4/1978 Council ..... 166/77.53
4,676,312 A * 6/1987 Mosing et al. ..... 166/77.53
5,311,937 A * 5/1994 Masaki et al. ..... 166/77.53
5,791,410 A * 8/1998 Castille et al. ..... 166/77.1
5,806,589 A * 9/1998 Lang ..... 166/77.53
5,909,768 A 6/1999 Castille et al.
6,386,282 B1 * 5/2002 Jansch ..... 166/53
6,742,596 B2 6/2004 Haugen
6,938,697 B2 9/2005 Haugen
6,997,251 B2 * 2/2006 Baird ..... 166/77.51
7,073,598 B2 * 7/2006 Haugen ..... 166/380
7,086,461 B2 * 8/2006 Schulze-Beckinghausen et al. ..... 166/77.53
7,281,587 B2 10/2007 Haugen
7,819,183 B2 * 10/2010 Borgstadt ..... 166/77.51
2009/0272542 A1 * 11/2009 Begnaud et al. ..... 166/380
2010/0193198 A1 * 8/2010 Murray et al. ..... 166/380

* cited by examiner

*Primary Examiner* — Brad Harcourt
*Assistant Examiner* — Michael Wills, III
(74) *Attorney, Agent, or Firm* — Bracewell & Giuliani LLP

(57) ABSTRACT

A system for deploying a string of pipe from a drilling rig into a well includes a spider for mounting on a rig floor and a pipe gripper attached to the top drive. A hydraulic safety circuit monitors hydraulic fluid pressure at an apply port of the gripper and prevents hydraulic fluid pressure from being directed to move the slips to the released position if hydraulic fluid pressure is not already present at the apply port of the gripper. The safety circuit also monitors hydraulic fluid pressure at the apply port of the spider and prevents release hydraulic fluid pressure from being directed to move the gripping members to the released position if apply hydraulic fluid pressure is not already present at the apply port of the spider.

20 Claims, 3 Drawing Sheets

HYDRAULIC INTERLOCK SYSTEM BETWEEN CASING GRIPPER AND SPIDER

CROSS REFERENCE TO RELATED APPLICATION

This application claims priority to provisional application 61/261,570 filed Nov. 16, 2009.

FIELD OF THE INVENTION

This invention relates to a system for preventing a string of casing from being accidentally dropped from a drill rig into a wellbore when employing a power spider and a casing gripper mounted to a top drive.

BACKGROUND OF THE INVENTION

In one type of running casing into a well or drilling with casing, the string of casing being made up is suspended in the well by a spider at the rig floor. The spider has hydraulically actuated slips. A pipe gripper mounts to the top drive, the pipe gripper having hydraulically actuated gripping members that grip an additional joint of casing to be made up to the string of casing. The operator rotates the top drive, which rotates the gripping members to make up the additional joint of casing with the string of casing. The operator then lifts the top drive, which raises the entire string of casing. The operator releases the spider slips and lowers the entire string of casing until the upper end of the newly added joint of casing is near the rig floor. The operator releases the gripper and picks up a new joint of casing to repeat the process.

A string of casing often contains hundreds of casing joints. Occasionally, an operator will inadvertently direct release fluid pressure to the spider slips when the gripper is in a released position. The weight of the string of casing may be adequate to prevent the release fluid pressure to release the slips; the slips normally have to move upward in order to release, and the casing string weight might prevent the slips from moving upward even if hydraulic fluid pressure is being applied. If the weight is not at that level, the slips will release and the entire string of casing will slide downward in the well. Depending on how far the casing slides, the results could be disastrous. Similarly, an operator might inadvertently direct release fluid pressure to the gripper when the spider slips are released.

SUMMARY

The system has a hydraulic safety circuit that monitors apply hydraulic fluid pressure at the gripper and prevents hydraulic fluid pressure from being directed to move the slips to the released position if apply hydraulic fluid pressure is not already being directed to hold the gripping members in the gripping position. The safety circuit also monitors apply hydraulic fluid pressure at the spider and prevents release hydraulic fluid pressure from being directed to move the gripping members to the released position if apply hydraulic fluid pressure is not already being directed to hold the slips in the gripping position.

Spider hydraulic apply and release lines extend between the spider control valve and the spider. Gripper hydraulic apply and release lines extend between the gripper control valve and the gripper. The safety circuit prevents hydraulic fluid pressure from being directed through the spider release line to the spider unless hydraulic fluid pressure is being directed through the gripper apply line to the gripper. The safety circuit prevents hydraulic fluid pressure from being directed through the gripper release line to the spider unless hydraulic fluid pressure is being directed through the spider apply line to the spider.

In a preferred embodiment, a gripper safety valve is connected into the release line between the spider control valve and the release port on the spider. A spider safety valve is connected into the release line between the gripper control valve and the release port on the gripper. The gripper safety valve blocks hydraulic fluid pressure being directed to the release port on the spider if the hydraulic fluid pressure at the apply port on the gripper is zero. The spider safety valve blocks hydraulic fluid pressure being directed to the release port on the gripper if the hydraulic fluid pressure at the apply port on the spider is zero.

The safety valves may be pilot operated check valves. A spider pilot line extends from the gripper apply line to the spider check valve to deliver hydraulic fluid pressure from the gripper apply line to the spider check valve to move the spider check valve to an open position. A gripper pilot line extends from the spider apply line to the gripper check valve to deliver hydraulic fluid pressure from the spider apply line to the gripper check valve to move the gripper check valve to an open position.

In one embodiment, a spider pilot bleed off line extends from the spider pilot line and is in continuous fluid communication with the reservoir. A gripper pilot bleed off line extends from the gripper pilot line and is in continuous fluid communication with the reservoir. The bleed off lines have flow areas sufficiently small so as to allow adequate hydraulic fluid pressure in the spider and gripper apply lines to actuate the spider and the gripper respectively. The flow is large enough, however, to allow the spider and gripper pilot lines to bleed off to the reservoir when fluid pressure does not exist in the spider and gripper apply lines.

The safety circuit may also include a sensing mechanism that physically senses whether the gripping members are in the gripping position, and which blocks any hydraulic fluid pressure at the spider release port if the gripping members are not in the gripping position, even if hydraulic fluid pressure at the apply port of the gripper is above zero. This function may be accomplished with a limit switch valve connected in the spider pilot line and having open and closed positions. In one embodiment, a cam is mounted to a first component of the gripper and a cam follower is mounted to a second component of the gripper. The first and second components move relative to each other when the gripping members move to the gripping position. The cam and cam follower are positioned so as to place the limit switch valve in the open position only when the gripping members are in a true gripping position.

DETAILED DESCRIPTION OF THE INVENTION

Figure 1:
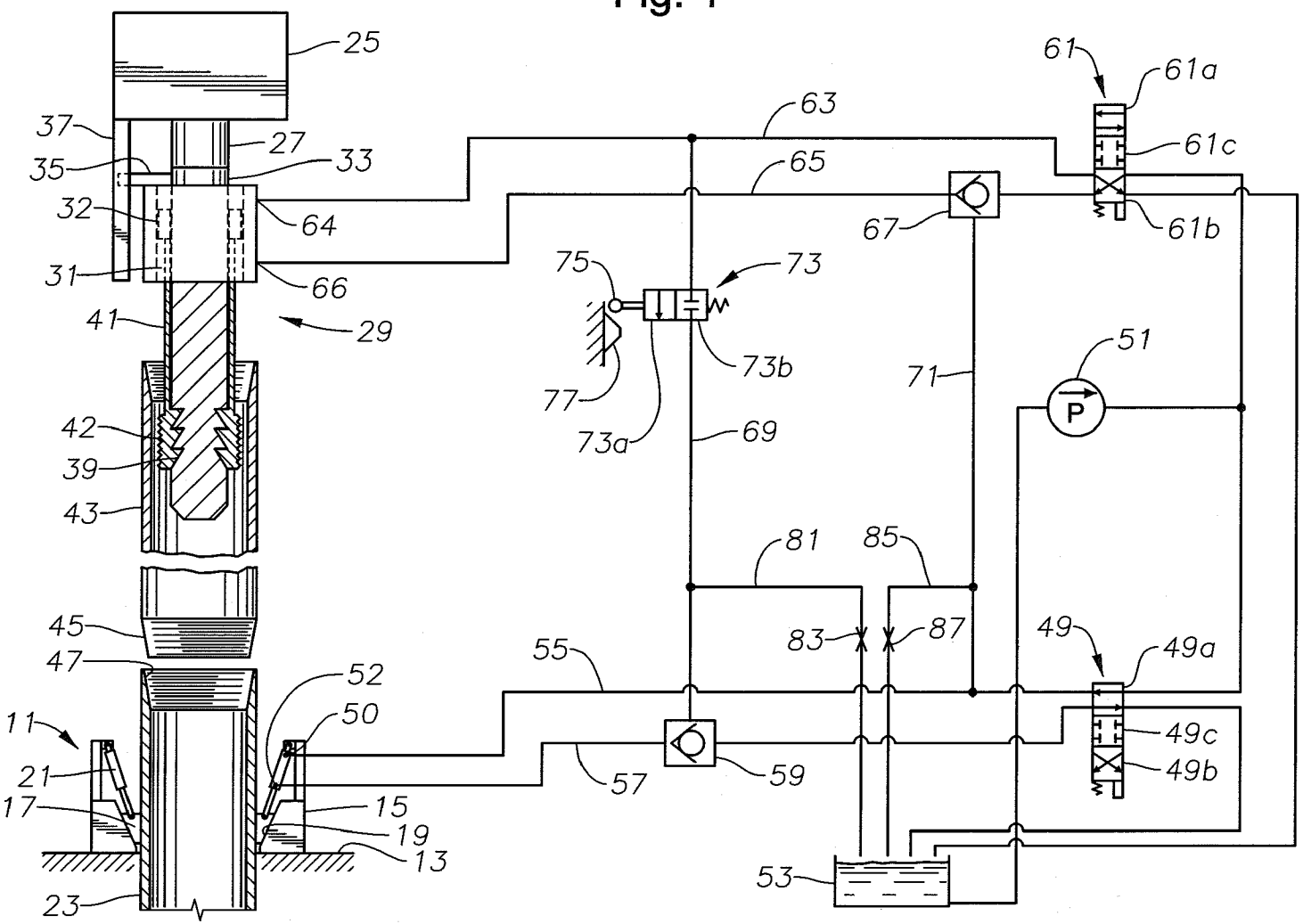
FIG. 1 is a schematic view of a hydraulic interlock system between a casing gripper and a spider, showing the gripper in a released position and the spider in a gripping position.

Referring to FIG. 1, a first tool or spider 11, also called "slips", is illustrated mounted on a rig floor 13. Spider 11 locates on or within a rotary table on rig floor 13 and has a housing 15 that carries a plurality of slips 17. Slips 17 are gripping members that slide on ramps 19 located in housing 15. Slips 17 are movable from the gripping position shown in FIG. 1 upward and outward to the released position shown in FIG. 2. Hydraulic cylinders 21 move slips 17 between the gripping and released positions. Hydraulic cylinders 21 are pivotally mounted to housing 15 and slips 17 in this example, and they may be configured in a variety of manners. In FIG. 1, spider 11 is illustrated with slips 17 gripping and supporting the weight of a string of casing 23 extending into the well. The upper end of casing string 23 extends a short distance above spider 11. The term "casing" is used herein broadly to include other tubular members to be run in and cemented in a well, such as liner pipe. The drilling rig has a top drive 25 in this embodiment. Top drive 25 is a power unit that is capable of upward and downward movement along a track secured in the derrick (not shown). Top drive 25 has a quill or drive stem 27 that it rotates. A second tool or casing gripper 29 is suspended from quill 27. Casing gripper 29 has an actuator 31 that is typically hydraulic and comprises a piston 32 and typically a spring that biases the piston toward a gripping position. A mandrel 33 extends through actuator 31 and is rotatable relative to actuator 31. Mandrel 33 secures to the lower end of quill 27 for rotational and axial movement therewith.

Figure 3:
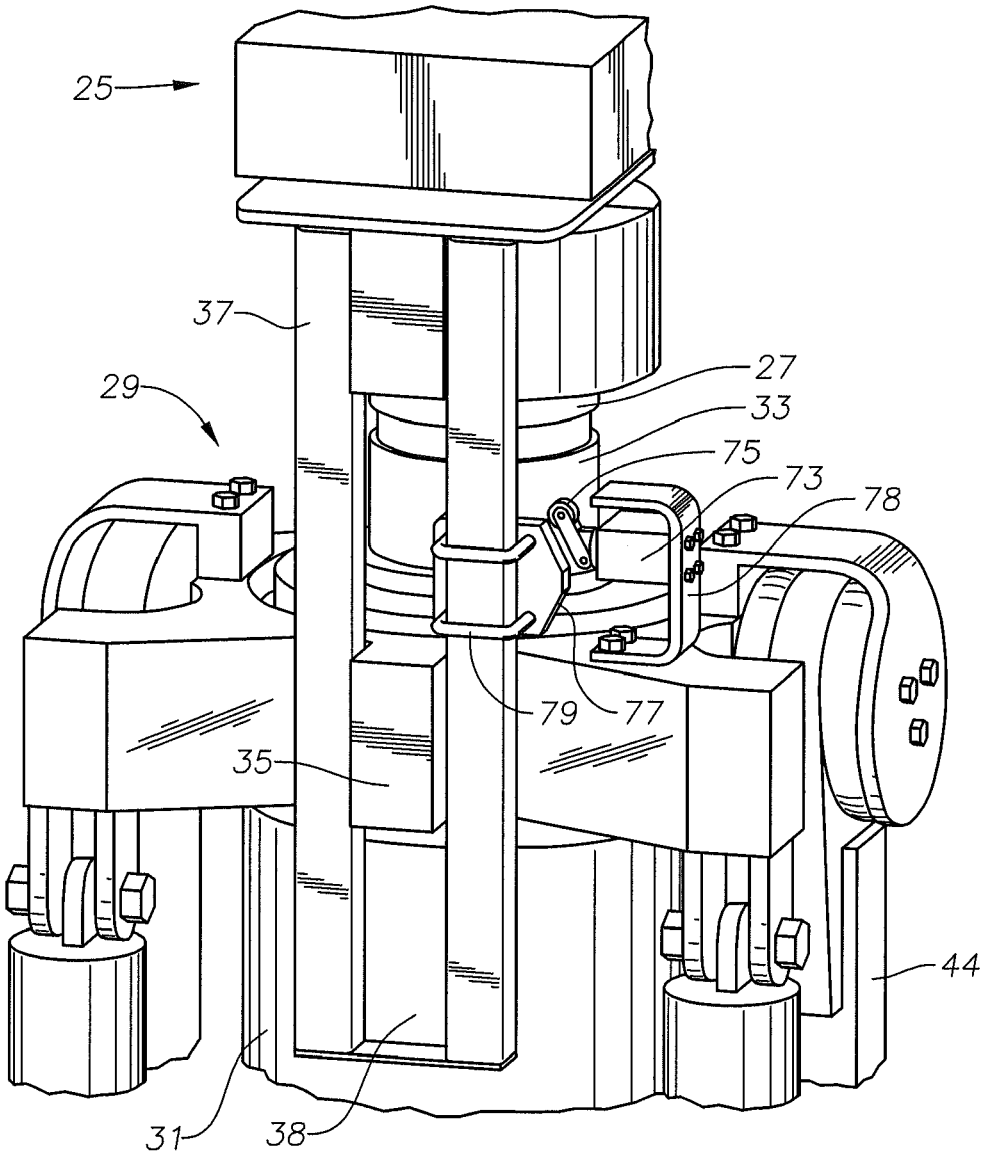
FIG. 3 is an elevational view of a portion of the casing gripper, showing a limit switch valve, and a cam.

Actuator 31 has an anti-rotation key 35 that prevents actuator 31 from rotating with quill 27 and mandrel 33. In this example, actuator key 35 engages an anti-rotation bracket 37 that is rigidly secured to and extends downward from top drive 25. As shown in FIG. 3, bracket 37 may comprise two elongated members with a vertically extending slot 38 between them into which anti-rotation key 35 inserts. Actuator 31 moves axially or vertically relative to top drive 25 and mandrel 33 while stroking between gripping and released positions. While moving, anti-rotation key 35 will slide along slot 38. Other anti-rotation devices are also feasible, such as an anti-rotation member that extends from actuator 31 horizontally over into engagement with the track that top drive 25 engages as it moves up and down the derrick.

Gripper 29 could be either a type that grips an inner diameter of a tubular member or an outer diameter. The gripper illustrated is a type that grips an inner diameter of a tubular member. A plurality of ramps or cam surfaces 39 are formed on a lower portion of mandrel 33. Cam surfaces 39 comprise generally saw tooth-shaped grooves in this example. A plurality of links 41 extend downward from actuator 31, each having a slip or gripping member 42 on its lower end. Links 41 are spaced circumferentially apart from each other around mandrel 33. Links 41 are coupled to the piston within actuator 31 for axial movement therewith. Links 41 are rotatable relative to actuator 31 as they rotate in unison with mandrel 33. Bearings (not shown) are employed between the piston and the links 41 to accommodate this movement. When supplied with hydraulic fluid pressure to release, actuator 31 will stroke links 41 downward relative to mandrel cam surfaces 39 from the released position shown in FIG. 1 to the gripping position shown in FIG. 2. Each gripping member 42 has a mating cam surface that engages one of the cam surfaces 39. When stroked axially in the downward direction in this example, gripping members 42 will move radially outward. When actuator 31 is supplied with hydraulic fluid pressure on the release side of the piston, it draws links 41 and gripping members 42 upward relative to mandrel 33 to the released position shown in FIG. 1. As the piston within actuator 31 moves between its upper and lower positions, the outer housing of actuator 31 will also move upward and downward relative to top drive 25 and anti-rotation bracket 37. Actuator 31 may have a coil spring that urges gripping members 42 downward toward the gripping position.

Figure 2:
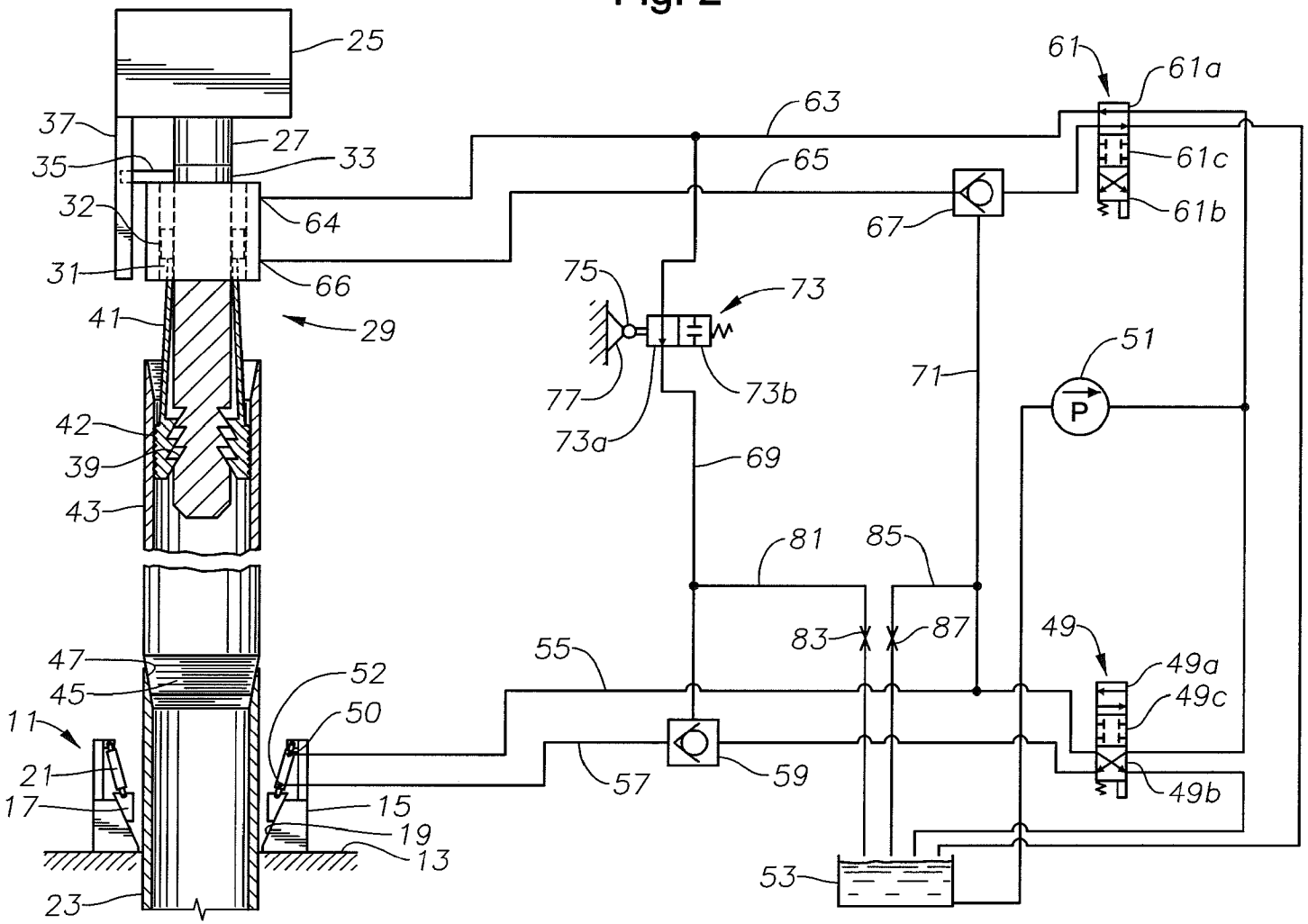
FIG. 2 is a schematic view of the hydraulic interlock system of FIG. 1, showing the gripper in a gripping position and the spider in a released position.

In the position of FIG. 1, mandrel 33 is shown being inserted into the upper end of an additional single joint of casing 43 that is to be connected to the upper end of casing string 23. Although not shown, a set of single joint elevators is suspended from actuator 31 by links or bails 44 (FIG. 3). The elevators will lift casing joint 43 and support it as it swings over and vertically aligns with casing string 23. FIG. 1 shows a threaded pin 45 on the lower end of casing joint 43 resting on a threaded box 47 located on the uppermost joint of casing string 23. Box 47 is illustrated as being integral with the uppermost joint of casing 23. However, each box 47 is normally a separate casing collar secured by threads to each joint of casing string 23. After gripping members 42 are in gripping engagement with single casing joint 43, the operator causes top drive 25 to rotate mandrel 33, which causes single casing joint 43 to screw into engagement with box 47 as illustrated in FIG. 2. Gripping members 42 can alternately be configured to grip the outer diameter of single casing joint 43 rather than the inner diameter.

The hydraulic system for spider 11 includes a spider control valve 49 that is manually actuable by an operator on rig floor 13. Spider control valve 49 can be of different types for supplying hydraulic fluid pressure to spider 11. In this embodiment, spider control valve 49 is a three-position valve having a gripping position 49*a* for directing apply pressure to spider cylinders 21 to cause slips 17 to grip casing string 23. Spider control valve 49 also has a release position 49*b* that directs release hydraulic fluid pressure to the opposite sides of hydraulic cylinders 21, causing slips 17 to move to the released position of FIG. 2. Spider control valve 49 may also have a closed position 49*c*, which blocks the flow of hydraulic fluid in either direction to or from hydraulic cylinders 21. FIG. 1 shows spider control valve 49 in gripping position 49*a*, and FIG. 2 shows it in released position 49*b*.

A hydraulic fluid pump 51 will supply hydraulic fluid pressure to spider control valve 49 as illustrated. Hydraulic pump 51 draws and returns fluid to a reservoir 53. Both pump 51 and reservoir 53 are connected to spider control valve 49. A spider apply line 55 leads from spider control valve 49 to apply ports 50 on hydraulic cylinders 21. A spider release line 57 leads from spider control valve 49 to release ports 52 on opposite sides of the pistons in hydraulic cylinders 21.

A hydraulic safety circuit includes a spider safety valve, which may be a pilot actuated check valve 59 mounted in spider release line 57. Spider check valve 59 will block the flow of hydraulic fluid pressure through spider release line 57 to hydraulic cylinders 21 even if spider control valve 49 is in release position 49*b*, unless actuated by pilot fluid pressure, as will be explained subsequently. Spider check valve 59 is biased to a closed position for flow to release ports 52 and will open only when receiving a hydraulic pilot signal. Spider check valve 59 will not block any flow from release ports 52 back to spider control valve 49 and reservoir 53 when spider control valve 49 is in apply position 49*a*. Spider check valve could alternately be a valve that selectively blocks flow in both directions if provisions are made for allow return flow through release line 57 when fluid pressure is applied to apply ports 50.

The hydraulic system for actuator 31 includes a gripper control valve 61. In this example, gripper control valve 61 is of the same type as spider control valve 49, but it could differ. Gripper control valve 61 is also a three-position manually actuated valve, having an apply position 61*a*, a release position 61*b*, and a closed position 61*c*. In the apply position 61*a*, a gripper control line 63 will be supplied with hydraulic fluid pressure from pump 51. Gripper apply line 63 leads to an apply port 64 on the upper side of piston 32 within gripper actuator 31. While in the release position 61*b*, hydraulic fluid pressure will be supplied to a gripper release line 65 that extends from gripper control valve 61 to a release port 66 on the opposite side of piston 32 of gripper actuator 31.

The hydraulic safety circuit also includes a gripper safety valve, which may be a pilot actuated check valve 67 located within gripper release line 65. Gripper check valve 67 will block the flow of hydraulic fluid from pump 51 to the release side of the piston of actuator 31 even if control valve 61 is in position 61*b*. It will allow flow to release port 66 only if gripper control valve 61 is in release position 61*b* and pilot hydraulic fluid pressure is received by pilot check valve 67. Gripper check valve 67 is biased to a closed position to flow to release port 66 and will open to flow to release port 66 only if receiving a hydraulic fluid pressure pilot signal. Gripper check valve 67 will freely allow flow from release port 64 back to gripper control valve 61 and reservoir 53 when gripper control valve 61 is in apply position 61*a*. Gripper check valve 67 could alternately be a valve that closes flow in both directions if provisions are made for allow return flow through release line 65 to reservoir 53 when fluid pressure is applied to apply port 64.

The hydraulic pilot signal to spider check valve 59 is delivered by a spider pilot line 69 that extends to gripper apply line 63. A gripper pilot line 71 extends from gripper check valve 67 to spider apply line 55 to provide a hydraulic pilot signal. If hydraulic fluid pressure in gripper apply line 63 is zero, spider pilot line 69 will not be able to deliver hydraulic fluid pressure to spider check valve 59, and release hydraulic fluid pressure will not be supplied to release ports 52 on spider 11. This interlocking arrangement reduces the chance for an operator to inadvertently release spider 11 when gripper is released and vice-versa.

With some types of grippers, however, the gripping members might be supplied with apply fluid pressure at apply port 64 but not located within or around a casing joint. Apply port 64 would have hydraulic pressure above zero, thus a hydraulic pilot signal would be applied to spider check valve 59, which would allow the operator to inadvertently release spider 11. The operator might not be able to see that gripper 29 is spaced above the upper end of casing joint 43 rather than gripping casing joint 43 because gripper 29 will be about 40 feet above the operator. To prevent this occurrence, a device to physically sense whether gripper 29 is in true gripping engagement with casing joint 43 may be employed. This device may be a variety of types. In this example, the device includes a limit switch valve 73, which may be connected in spider pilot line 69. Limit switch valve 73 is moved between closed and open positions 73*a* and 73*b* by movement of a probe such as a cam follower 75, which is shown schematically. Limit switch valve 73 is biased to the closed position 73*a*. Cam follower 75 is positioned to engage a cam 77, which has upper and lower inclined surfaces that join at a straight central portion or crest. Cam follower 75 will move onto the central portion of cam 77 when gripper actuator 31 reaches a true gripping position, causing limit switch valve 73 to move from closed position 73 to open position 73*b*.

Gripper 29 has at least two components that move relative to each other when stroking from the released to the gripping position. In this embodiment, cam follower 75 and limit switch valve 73 are mounted to actuator 31, as illustrated in FIG. 3, for movement with actuator 31 as it strokes between gripping and released positions. As shown in FIG. 3, limit switch valve 73 may be mounted to a bracket 78, which in turn is mounted on an upper end portion of actuator 31. In this embodiment, cam 77 comprises a plate secured by U-bolts 79 to one portion of anti-rotation bracket 37, which does not move axially with actuator 31 as actuator 31 strokes between released and gripping positions. The mounting places for cam 77 and cam follower 75 could be reversed or placed at other points on gripper 29. One of cam 77 and cam follower 75 must move with actuator 31 as it strokes between released and gripping positions, and the other must be stationary relative to top drive 25. Preferably, neither is located on a portion of gripper assembly 29 that rotates with drive quill 27. Cam 77 could alternately comprise a stop member, rather than a cam member.

When engaged by cam follower 75, cam 77 pushes cam follower 75 to the right, as shown in FIG. 2, causing limit switch valve 73 to move from the closed position 73*a* to the open position 73*b*. As illustrated in FIG. 1, when actuator 31 is in the released position, cam follower 75 is axially spaced above cam 77. When actuator 31 moves to the fully gripping position, which is shown in FIG. 2, cam follower 75 will be located on the central portion of cam 77, pushing limit switch valve 73 to the open position 73*b*. If actuator 31 moves too far axially when moving from the release position to the gripping position, cam follower 75 will be below cam 77, thus limit switch valve 73 will return to the closed position 73*a*. Moving too far is an indication that gripper members 42 are not in a gripping position gripping pipe; rather, gripping members 42 have moved past the gripping position and are extending radially farther than normal because they have not contacted casing joint 43.

Another safety measure may be applied to the safety circuit to avoid erroneous positive hydraulic signals. It is possible that apply pressure within spider pilot line 69 fails to bleed back to reservoir 53 when gripper control valve 61 is in a position other than gripping position 61*a*. Similarly, it is possible that apply pressure in gripper pilot line 71 fails to bleed back to reservoir 53 when spider control valve 49 is in a position other than apply position 49*a*. If so, the trapped pressure in pilot lines 69 or 71 could mistakenly open spider check valve 59 or gripper check valve 67. The opening of check valve 59 when apply pressure has not actually moved gripper 29 to the gripping position could result in both gripper 29 and spider 11 being simultaneously in the released positions. To reduce the chance of trapped pressure causing a false positive signal in spider check valve 59, a bleed off line 81 is tapped into spider pilot line 69. Bleed off line 81 is continuously open and extends to reservoir 63. Bleed off line 81 has a flow area small enough such that when apply fluid pressure is applied to gripper apply line 63, the leakage to reservoir 53 will not be so high to prevent gripper 29 from moving to the gripping position. In this example, the small flow area is provided by fluid restrictor or orifice 83 mounted in bleed off line 81. Orifice 83 has an inner diameter smaller than an inner diameter of bleed off line 81. For example, the inner diameter of orifice 83 may be 0.015 inch. The small inner diameter of orifice 83 still allows any trapped fluid pressure in spider pilot line 69 to bleed off to reservoir 53. Similarly, a bleed off line 85 leads from gripper pilot line 71 to reservoir 53. Bleed off line 85 also has an orifice or fluid restrictor 87. Alternately, both bleed off lines 81 and 85 could join each other and have a single fluid restrictor before reaching reservoir 53.

In operation, while lowering casing string 23 into a wellbore for either a cementing operation or a drilling operation, the operator will assemble a string of casing 23 and suspend it from spider 11 as shown in FIG. 1. Spider slips 17 will grip casing string 23 to support the weight of casing string 23 as it extends into the well. The operator uses a pipe handling mechanism, typically elevators, to pick up single joint of casing 43 for connection into casing string 23. The operator then lowers gripper mandrel 33 into the upper end of single casing joint 43. The operator then applies hydraulic fluid pressure to gripper actuator 31 by placing control valve 61 in position 61*a*. This causes actuator 31 and gripping members 42 to move downward relative to mandrel 33. Gripping members 42 move radially outward and grip the inner diameter of single casing joint 43. The operator will then rotate top drive quill 27, which causes single casing joint 43 to screw into the uppermost threaded box 47 of casing string 23, as shown in FIG. 2. The operator then moves top drive 25 upward to cause gripper 29 to support the entire weight of casing string 23, including the newly added casing joint 43.

When actuator 31 moved to the gripping position, it caused cam follower 75 to move onto the central portion of cam 77 as schematically illustrated in FIG. 2. Cam follower 75 shifts limit switch valve 73 to open position 73*b*. While retaining gripper control valve 61 in gripping position 61*a*, the operator releases spider 11 by manually shifting spider control valve 49 to release position 49*b*, which applies fluid pressure to release line 57. Because hydraulic fluid pressure remains in casing gripper apply line 63 and because limit switch valve 73 is now in the open position, spider check valve 59 will be open. The hydraulic fluid pressure thus flows through release ports 52 into cylinders 21 and causes slips 17 to move to the released position shown in FIG. 2.

The operator will then lower top drive 25 and casing string 23 down until single casing joint 43 is positioned with its upper end a short distance above spider 11. The operator then will direct apply pressure to spider apply line 55, causing slips 17 to move to the gripping position. The operator then repeats the sequence.

The operator can always apply fluid pressure to spider 17 and to gripper 29 to cause them to grip, regardless of the position of limit switch valve 73 or the status of check valves 59 and 67. Check valves 59, 57 and limit switch valve 73 serve to prevent the operator from inadvertently releasing spider 11 when casing gripper 41 is not properly supporting the weight of casing string 23 or vice versa. Hydraulic fluid pressure cannot flow through release line 57 of spider 11 unless spider check valve 59 is open. Check valve 59 is open only when hydraulic fluid pressure exists in gripper apply line 63 and cam follower 75 is properly engaging cam 77. For example, if cam follower 75 does not move far enough to center on cam 77, limit switch valve 73 would still be in the closed position 73*a*. If cam follower 75 has moved less than the required distance, it is likely that casing gripper 29 is not properly gripping the casing. A greater than required travel distance of cam follower 75 indicates that gripping members 42 are being actuated in air rather than in casing. Similarly, the operator will not be able to apply release pressure to gripper release line 65 unless its check valve 67 is open. Check valve 67 will be open only if hydraulic fluid pressure exists in apply line 55 of spider 11.

Preferably, the relative positions of cam follower 75 and cam 77 can be adjusted for different casing diameters. This may be accomplished by either moving cam follower 75 axially up and down relative to cam 77 or vice versa. A larger diameter casing requires more travel for gripping members 42 to grip the inner diameter of the casing than a smaller diameter.

While the invention has been described in only a few of its foams, it should be apparent to those skilled in the art that it is not so limited but is susceptible to various changes without departing from the scope of the invention. For example, the interlock arrangement shown may be used with tools having hydraulically actuated slips other than spiders and pipe grippers.

The invention claimed is:

1. A drilling rig system for connecting pipe, comprising:

a first tool having slips that are hydraulically actuated to move the slips between a released position and a gripping position in gripping engagement with a first pipe;

a second tool having gripping members that are hydraulically actuated to move between a released position and a gripping position in gripping engagement with a second pipe member for connection to the first pipe;

a manually operable first tool control valve having an apply position to direct apply hydraulic fluid pressure to move the slips to the gripping position and having a release position to direct release hydraulic fluid pressure to move the slips to the released position;

a manually operable second tool control valve having an apply position to direct apply hydraulic fluid pressure to move the gripping members to the gripping position and having a release position to direct release hydraulic fluid pressure to move the gripping members to the released position;

a hydraulic safety circuit that senses apply hydraulic fluid pressure at the second tool and prevents hydraulic fluid pressure from being directed to move the slips to the released position if apply hydraulic fluid pressure is not already being directed to hold the gripping members in the gripping position; and the safety circuit also senses apply hydraulic fluid pressure at the first tool and prevents release hydraulic fluid pressure from being directed to move the gripping members to the released position if apply hydraulic fluid pressure is not already being directed to hold the slips in the gripping position.

2. The system according to claim 1, wherein:

first tool hydraulic apply and release lines extend between the first tool control valve and the first tool;

second tool hydraulic apply and release lines extend between the second tool control valve and the second tool;

the safety circuit prevents hydraulic fluid pressure from being directed through the first tool release line to the first tool unless hydraulic fluid pressure is being directed through the second tool apply line to the second tool and the gripping members are in the gripping position; and the safety circuit prevents hydraulic fluid pressure from being directed through the second tool release line to the first tool unless hydraulic fluid pressure is being directed through the first tool apply line to the first tool.

3. The system according to claim 1, wherein:

first tool hydraulic apply and release lines extend between the first tool control valve and apply and release ports on the first tool;

second tool hydraulic apply and release lines extend between the second tool control valve and apply and release ports on the second tool;

the safety circuit prevents hydraulic fluid pressure from being directed through the first tool release line to the release port on the first tool if hydraulic fluid pressure at the apply port of the second tool is zero; and the safety circuit prevents hydraulic fluid pressure from being directed through the second tool release line to the release port on the second tool if hydraulic fluid pressure at the apply port of the first tool is zero.

4. The system according to claim 1, wherein:

first tool hydraulic apply and release lines extend between the first tool control valve and apply and release ports on the first tool;

second tool hydraulic apply and release lines extend between the second tool control valve and apply and release ports on the second tool;

the safety circuit prevents hydraulic fluid pressure from being directed through the first tool release line to the release port on the first tool if hydraulic fluid pressure at the apply port of the second tool is zero;

the safety circuit prevents hydraulic fluid pressure from being directed through the second tool release line to the release port on the second tool if hydraulic fluid pressure at the apply line of the first tool is zero; and the safety circuit includes a sensing mechanism that physically senses a length of a stroke of the gripper members when apply hydraulic fluid pressure is applied to the second tool, and if the stroke is beyond a selected length, blocks any hydraulic fluid pressure at the first tool release port, even if hydraulic fluid pressure at the apply port of the second tool is above zero.

5. The system according to claim 1, wherein:

first tool hydraulic apply and release lines extend between the first tool control valve and apply and release ports on the first tool;

second tool hydraulic apply and release lines extend between the second tool control valve and apply and release ports on the second tool; the safety circuit comprises:

a first tool safety valve connected into the release line between the first tool control valve and the release port on the first tool;

a second tool safety valve connected into the release line between the second tool control valve and the release port on the second tool; and wherein the first tool safety valve blocks hydraulic fluid pressure being directed to the release port on the first tool if the hydraulic fluid pressure at the apply port on the second tool is zero; and the second tool safety valve blocks hydraulic fluid pressure being directed to the release port on the second tool if the hydraulic fluid pressure at the apply port on the first tool is zero.

6. The system according to claim 1, wherein the pipe second tool has a longitudinal axis and comprises a hydraulic actuator having two components that are axially movable relative to each other to move the gripping members along a stroke length between the gripping and released positions, and the safety circuit further comprises:

a limit switch valve having open and closed positions;

a cam mounted to one of the components; and a cam follower mounted to the other of the components and in engagement with the cam for moving the limit switch valve between the open and closed positions in response to relative axial movement of the components; and the cam and cam follower are positioned so as to place the limit switch valve in the open position only when the gripping members are in the gripping position, and to place the limit switch in a closed position if a selected amount of the stroke length is exceeded; and the limit switch is positioned in the safety circuit so as to block hydraulic fluid pressure from the first tool control valve to the first tool while the limit switch is in the closed position.

7. A drilling rig system for connecting pipe, comprising:

a first tool having slips that are hydraulically actuated to move the slips between a released position and a gripping position in gripping engagement with a first pipe;

a second tool having gripping members that are hydraulically actuated to move between a released position and a gripping position in gripping engagement with a second pipe member for connection to the first pipe;

a manually operable first tool control valve having an apply position to direct apply hydraulic fluid pressure to move the slips to the gripping position and having a release position to direct release hydraulic fluid pressure to move the slips to the released position;

a manually operable second tool control valve having an apply position to direct apply hydraulic fluid pressure to move the gripping members to the gripping position and having a release position to direct release hydraulic fluid pressure to move the gripping members to the released position;

a hydraulic safety circuit that monitors apply hydraulic fluid pressure at the second tool and prevents hydraulic fluid pressure from being directed to move the slips to the released position if apply hydraulic fluid pressure is not already being directed to hold the gripping members in the gripping position;

the safety circuit also monitoring apply hydraulic fluid pressure at the first tool and prevents release hydraulic fluid pressure from being directed to move the gripping members to the released position if apply hydraulic fluid pressure is not already being directed to hold the slips in the gripping position; wherein:

hydraulic first tool apply and first tool release lines extend between the first tool control valve and first tool apply and first tool release ports on the first tool;

hydraulic second tool apply and second tool release lines extend between the second tool control valve and second tool apply and second tool release ports on the second tool;

the safety circuit comprises:

a pilot operated first tool check valve connected into the first tool release line, the first tool check valve having a closed position blocking hydraulic fluid pressure to the first tool release port;

a pilot operated second tool check valve connected into the second tool release line, the second tool check valve having a closed position blocking hydraulic fluid pressure to the second tool release port;

a first tool pilot line extending from the second tool apply line to the first tool check valve to deliver hydraulic fluid pressure from the second tool apply line to the first tool check valve to move the first tool check valve to an open position; and a second tool pilot line extending from the first tool apply line to the second tool check valve to deliver hydraulic fluid pressure from the first tool apply line to the second tool check valve to move the second tool check valve to an open position.

8. The system according to claim 7, wherein the system has a hydraulic fluid reservoir, and further comprises:

a first tool pilot bleed off line extending from the first tool pilot line and in continuous fluid communication with the reservoir;

a second tool pilot bleed offline extending from the second tool pilot line and in continuous fluid communication with the reservoir; and each of the bleed off lines having a flow area sufficiently small so as to allow adequate hydraulic fluid pressure in the first tool and second tool apply lines to actuate the first tool and the second tool respectively, but to allow the first tool and second tool pilot lines to bleed off to the reservoir when hydraulic fluid pressure does not exist in the first tool and second tool apply lines.

9. The system according to claim 7, wherein the pipe second tool has a longitudinal axis and comprises a hydraulic actuator having two components that are axially movable relative to each other to move the gripping members between the gripping and released positions, and the safety circuit further comprises:

a limit switch valve connected in the first tool pilot line and having open and closed positions;

a cam mounted to one of the components; and a cam follower mounted to the other for moving the limit switch valve between the open and closed positions in response to relative axial movement of the two components; and the cam and cam follower are positioned so as to place the limit switch valve in the open position only when the gripping members are in the gripping position.

10. A system for deploying a string of pipe from a drilling rig into a well, comprising:

a spider for mounting on a rig floor, the spider having slips that are hydraulically actuated to move the slips between a released position and a gripping position in gripping engagement with a string of pipe extending into the well;

a pipe gripper that is movable up and down a derrick of the rig and has gripping members that are hydraulically actuated to move the gripping members between a released position and a gripping position in gripping engagement with a pipe member for connection to the string of pipe;

a manually operable spider control valve having an apply position to direct hydraulic fluid pressure to move the slips to the gripping position and having a release position to direct hydraulic fluid pressure to move the slips to the released position;

a manually operable gripper control valve having an apply position to direct hydraulic fluid pressure to move the gripping members to the gripping position and having a release position to direct hydraulic fluid pressure to move the gripping members to the released position;

spider hydraulic apply and release lines extending between the spider control valve and apply and release ports on the spider;

gripper hydraulic apply and release lines extending between the gripper control valve and apply and release ports on the gripper;

a hydraulic safety circuit that senses pressure in the gripper apply port and prevents hydraulic fluid pressure from being directed through the spider release line to the spider release port if hydraulic fluid pressure in the gripper apply port is zero; and the safety circuit also senses pressure in the spider apply port and prevents hydraulic fluid pressure from being directed through the gripper release line to the gripper release port if hydraulic fluid pressure in the spider apply port is zero.

11. The system according to claim 10, wherein the safety circuit includes a sensing mechanism that physically senses whether the gripping members are in the gripping position by sensing a stroke length of the grippers, and which blocks any hydraulic fluid pressure through the spider release line to the spider release port if the gripping members have exceeded a selected amount of the stroke length, even if hydraulic fluid pressure in the gripper apply port is above zero.

12. The system according to claim 10, wherein the safety circuit comprises:

a pilot operated spider check valve connected into the spider release line, the spider check valve having a closed position blocking hydraulic fluid pressure through the spider release line to the spider release port;

a pilot operated gripper check valve connected into the gripper release line, the gripper check valve having a closed position blocking hydraulic fluid pressure through the gripper release line to the gripper release port;

a spider pilot line extending from the gripper apply line to the spider check valve to deliver hydraulic fluid pressure from the gripper apply line to the spider check valve to move the spider check valve to an open position; and a gripper pilot line extending from the spider apply line to the gripper check valve to deliver hydraulic fluid pressure from the spider apply line to the gripper check valve to move the gripper check valve to an open position.

13. The system according to claim 12, wherein the pipe gripper has a longitudinal axis and comprises a hydraulic actuator having two components that are axially movable relative to each other to move the gripping members between the gripping and released positions, and the safety circuit further comprises:

a limit switch valve connected in the spider pilot line and having open and closed positions;

a cam mounted to one of the components; and a cam follower mounted to the other of the components for moving the limit switch valve between the open and closed positions in response to relative axial movement of the two components; and the cam and cam follower are positioned so as to place the limit switch valve in the open position only when the gripping members are in the gripping position.

14. The system according to claim 12, wherein the system has a hydraulic fluid reservoir, and further comprises:

a spider pilot bleed off line extending from the spider pilot line and in continuous fluid communication with the reservoir;

a gripper pilot bleed off line extending from the gripper pilot line and in continuous fluid communication with the reservoir; and each of the bleed off lines has a flow area sufficiently small so as to allow adequate hydraulic fluid pressure in the spider and gripper apply lines to actuate the spider and the gripper respectively, but to allow the spider and gripper pilot lines to bleed off to the reservoir when hydraulic fluid pressure does not exist in the spider and gripper apply lines.

15. The system according to claim 14, wherein each of the bleed off lines contains a flow restrictor having a smaller inner diameter than an inner diameter of the bleed off line in which the flow restrictor is mounted.

16. A method for deploying a string of pipe from a drilling rig into a well, the drilling rig having a spider on a rig floor with hydraulically actuated slips, the drilling rig having a pipe gripper that is movable up and down a derrick of the rig by a top drive and has gripping members that are hydraulically actuated, the method including the steps of:

(a) directing apply hydraulic fluid pressure to the spider to cause the slips to grip a string of pipe extending into the well;

(b) directing apply hydraulic fluid pressure to the gripper to cause the gripping members to grip a single pipe, and with the top drive, rotating the single pipe to secure the single pipe as a newly added pipe to an upper end of the string of pipe being held by the spider;

(c) with the top drive and the gripper, lifting the string of pipe, including the newly added pipe;

(d) releasing the slips by directing release hydraulic fluid pressure to the spider, and lowering the top drive until an upper end of the newly added pipe is a selected distance from the rig floor, then engaging the newly added pipe with the slips of the spider and releasing the gripping members by directing release hydraulic fluid pressure to the gripper;

the method having further steps for preventing an operator from releasing the slips of the spider while the gripper is released, and for preventing the operator from releasing the gripper when the spider is released, comprising:

(e) sensing apply hydraulic fluid pressure at the gripper and preventing release hydraulic fluid pressure from being directed to release the slips if the apply hydraulic fluid pressure is not already being directed to gripper; and (f) sensing apply hydraulic fluid pressure at the spider and preventing release hydraulic fluid pressure from being directed to release the gripper if apply hydraulic fluid pressure is not already being directed to the spider.

17. The method according to claim 16, further comprising:

placing a spider safety valve in a release line that applies the release fluid pressure to the spider;

placing a gripper safety valve in a release line that applies the release fluid pressure to the gripper;

wherein step (e) comprises communicating apply hydraulic fluid pressure at the gripper to the spider safety valve to cause the spider safety valve to open, the spider safety valve remaining closed to flow to release the spider if the apply hydraulic fluid pressure at the gripper is zero; and wherein step (f) comprises communicating apply hydraulic fluid pressure at the spider to the gripper safety valve to cause the gripper safety valve to open, the gripper safety valve remaining closed to flow to release the gripper if the apply hydraulic fluid pressure at the spider is zero.

18. The method according to claim 17, further comprising:

sensing a stroke length of the gripping members and preventing the spider safety valve from opening if the gripping members have exceeded a selected amount of the stroke length, even if apply hydraulic fluid pressure at the gripper is above zero.

19. The method according to claim 18, wherein directing apply hydraulic fluid pressure to the gripper causes a first component of the gripper to move relative to a second component of the gripper, and sensing the physical position of the gripping members comprises:

mounting a limit switch valve to the first component of the gripper and an actuator of the limit switch valve to the second component of the gripper;

connecting the limit switch valve in fluid communication with an apply line leading to the spider and biasing the limit switch valve to a closed position that blocks apply hydraulic fluid pressure to the spider; and movement of the gripper to the gripping position moves the actuator to open the limit switch valve.

20. The method according to claim 17, wherein:

the steps of communicating apply hydraulic fluid pressure to the spider and gripper safety valves comprises connecting spider and gripper pilot lines from the spider and the gripper to the spider and the gripper safety valves, respectively; and the method further comprises:

connecting bleed lines from the pilot lines into continuous communication with a hydraulic fluid reservoir, and providing the bleed lines with a sufficiently small area so as to allow apply hydraulic fluid pressure to be applied to the spider and the gripper;

when the apply hydraulic fluid pressure to the gripper is zero, allowing hydraulic fluid within the spider pilot line to bleed to the reservoir; and when the apply hydraulic fluid pressure to the spider is zero, allowing hydraulic fluid within the gripper pilot line to bleed to the reservoir.

* * * * *